US005900123A

United States Patent [19]

Gustavsson

[11] Patent Number: 5,900,123

[45] Date of Patent: May 4, 1999

[54] DEVICE FOR DISTRIBUTING LIQUID, ESPECIALLY WASHING LIQUID, FOR WASHING PAPER PULP

[75] Inventor: Lennart Gustavsson, Karlstad, Sweden

[73] Assignee: Kvaerner Fulping AB, Karlstad, Sweden

[21] Appl. No.: 08/596,124

[22] PCT Filed: Sep. 12, 1994

[86] PCT No.: PCT/SE94/00847

§ 371 Date: Feb. 9, 1996

§ 102(e) Date: Feb. 9, 1996

[87] PCT Pub. No.: WO95/08665

PCT Pub. Date: Mar. 30, 1995

[30] Foreign Application Priority Data

Sep. 22, 1993 [SE] Sweden ..... 9303096

[51] Int. Cl.[6] ..... D21H 23/00

[52] U.S. Cl. ..... 162/380; 162/60; 162/55

[58] Field of Search ..... 239/553.5, 553.3, 239/601, 596, 548, 551, 590, 590.5, 590.3, 553, 552; 162/60, 380, 55; 134/199

[56] References Cited

U.S. PATENT DOCUMENTS

| | | | |
|---|---|---|---|
| 2,266,223 | 12/1941 | Lund | 239/553 |
| 3,348,390 | 10/1967 | Richter . | |
| 3,776,471 | 12/1973 | Meyer et al. | 239/553.5 |
| 4,043,397 | 8/1977 | Glowienke | 239/553.5 |
| 4,951,879 | 8/1990 | Fay et al. | 239/553.5 |
| 5,027,620 | 7/1991 | Richter . | |
| 5,203,045 | 4/1993 | Golston . | |

FOREIGN PATENT DOCUMENTS

| | | |
|---|---|---|
| 0022068 | 1/1981 | European Pat. Off. . |

OTHER PUBLICATIONS

Opposition by Kamyr Inc. to patent SE 501,863 (appl. No. SE 9303096–3, dated Mar. 5, 1996.

*Primary Examiner*—Brenda A. Lamb
*Attorney, Agent, or Firm*—Dorsey & Whitney LLP

[57] ABSTRACT

The present invention relates to a device for distributing liquid, especially washing liquid for washing paper pulp, in a diffuser having at least one screen plate (1), comprising an apparatus for supplying the washing liquid and at least one elongated nozzle (2, 5) which can be connected to the apparatus and which extends down in front of the screen plate and is arranged to supply the liquid. The nozzle is provided with openings (7 to 12) for washing liquid which open out at different predetermined levels, and whose location is designed to provide an even distribution of washing liquid along the height of the screen plate. A channel (13 to 18) for supplying washing liquid can be arranged to each opening (7 to 12) in the nozzle (2, 5).

3 Claims, 1 Drawing Sheet

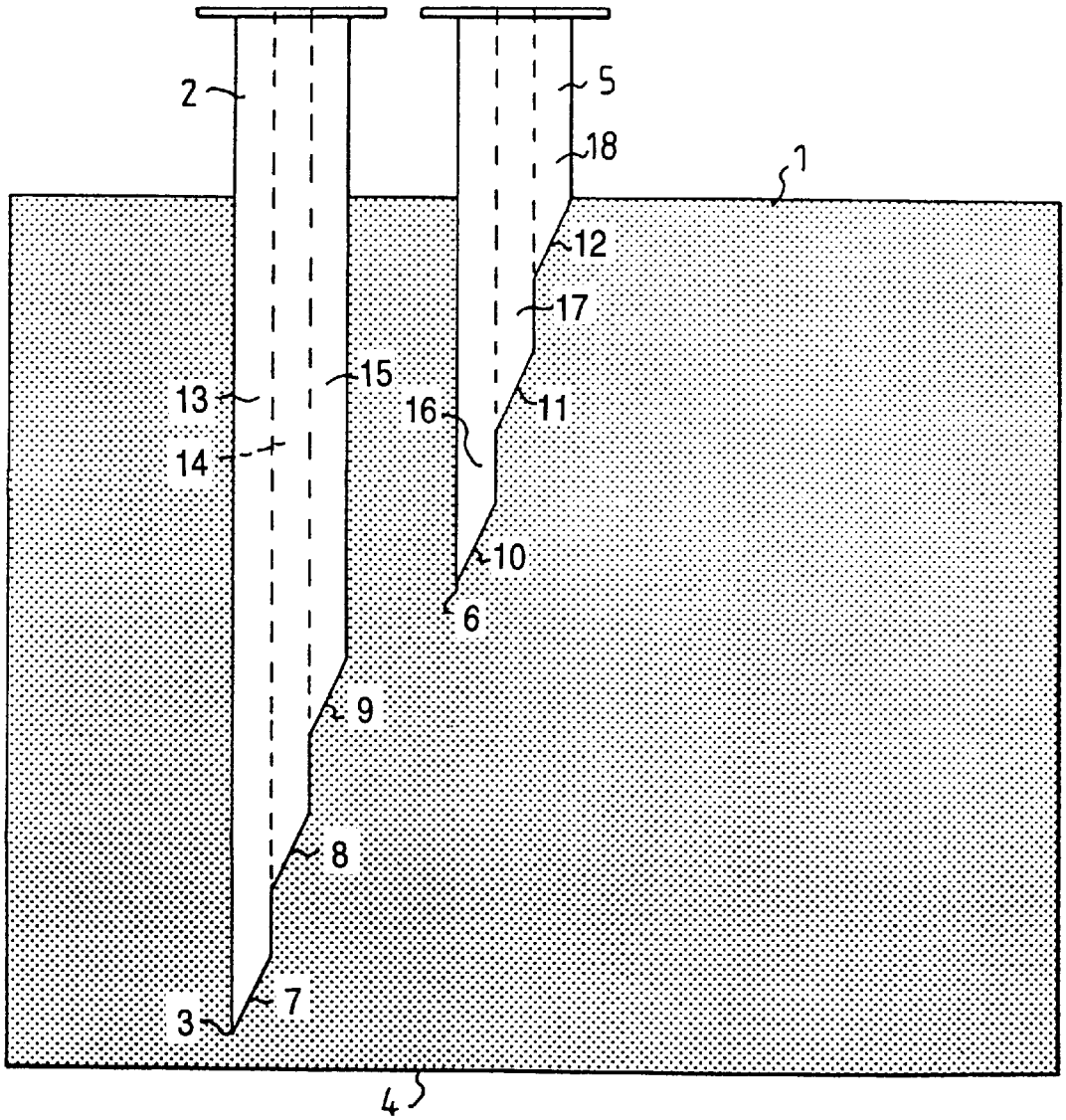
2
5
18
1
12
17
15
13
16
11
14
10
6
9
8
7
3
4

DEVICE FOR DISTRIBUTING LIQUID, ESPECIALLY WASHING LIQUID, FOR WASHING PAPER PULP

BACKGROUND OF THE INVENTION

1. Field of the Invention

The present invention relates to a device for distributing liquid, especially washing liquid for washing paper pulp, in a diffuser having at least one screen plate, comprising means for supplying the washing liquid and at least one elongated nozzle which can be connected to the washing liquid supply means, which projects down in front of the screen plate, and is arranged to supply the liquid.

2. Description of the Prior Art

Such a device is previously known through U.S. Pat. No. 3,348,390 which relates to a liquid distribution device in a diffuser with openings being arranged on two different levels—at the top and at the bottom—along the height of the screen plates. The washing liquid is thereby conveyed in separate conduit systems to the different levels, which results in a complicated system for supplying the washing liquid. In addition, it can give rise to uneven distribution of the washing liquid along the height of the screen plate.

In a further development, the washing liquid is supplied through two nozzles, namely a long nozzle which reaches to the lower part of the screen plate and a short nozzle which is designed to supply washing liquid to the upper part. The washing liquid is distributed to each nozzle by means of a rotatable so-called nozzle plate which is provided with a number of holes, more specifically throttle holes, the cross-sectional area of which is predetermined in relation to the current quantity of liquid passing through the nozzle. An uneven distribution of the liquid along the height of the screen plate also occurs when this device is used.

SUMMARY OF THE INVENTION

The object of the present invention is to produce a device in a diffuser of the type mentioned at the outset, which device is designed, to the greatest possible extent, to provide each part of the screen plate of the diffuser with its share of the washing liquid.

This object is achieved by a device of the type mentioned at the outset in which each of the nozzles is provided with openings for washing liquid which open out at different predetermined levels and that a channel for supplying washing liquid is arranged to each opening in the nozzle.

Preferred embodiments of the device have been given the features which are evident from the subclaims.

Use of the device according to the invention provides better distribution of the washing liquid along the entire height of the screen plate, which, in turn, must improve the efficiency of the machine and prevent local thickening in the screen, which can give rise to an increased requirement for hydraulic power.

BRIEF DESCRIPTION OF THE DRAWING

The invention is described in more detail below with reference to the attached FIG. 1, which shows a preferred embodiment of a screen plate.

DETAILED DESCRIPTION OF THE PREFERRED EMBODIMENTS

FIG. 1 shows a screen plate 1 which is arranged in a diffuser which is not shown. In front of the screen plate 1, a first, elongated distribution nozzle 2 is arranged in such a way that, in the main, it extends with its tip 3 to the lower edge 4 of the screen plate 1. A second, elongated distribution nozzle 5 extends with its tip 6 to immediately above the middle of the height of the screen plate. Both of the distribution nozzles 2 and 5 are designed to be connected to a nozzle plate, which is not shown, for supplying washing liquid to the nozzles via throttle holes, the cross-sectional area of which is predetermined in relation to the current quantity of liquid passing through the connected nozzle.

Each nozzle 2 and 5 is provided with three openings 7, 8, 9 and 10, 11, 12, respectively, which open out at different levels calculated from the tip and upwards, with the three openings 7, 8, 9 on the first nozzle 2 being distributed over the lower half of the screen plate 1 and the three openings 10, 11, 12 on the second nozzle 5 being distributed over the upper half of the screen plate 1. Thus, the washing liquid which flows into the diffuser out of the openings 7 to 12 is distributed evenly over the whole height of the screen plate.

Channels 13, 14, 15, each of which is connected to its own opening 7, 8 and 9, respectively, are arranged in the first distribution nozzle 2. In the same way, channels 16, 17, 18 are arranged in the second distribution nozzle 5, wherein each of these channels is connected to its own opening 10, 11 and 12, respectively. The distribution nozzles 2 and 5 are connected to the throttle holes in the nozzle plate. It is also possible to connect each channel 13 to 18 in distribution nozzle 2 or 5, respectively, to a socket, thereby rendering it possible for each channel to be connected to a throttle opening in the nozzle plate. As a consequence of the movement of the pulp or the location of the nozzles in the diffuser, it is possible to produce a differentiated supply of washing liquid to the channels in the nozzles.

By means of the embodiment shown in FIG. 1 and described above, washing or displacement liquid is distributed at six different levels of the height of the screen with the aid of the two nozzles 2 and 5. Naturally, it is possible, within the scope of the attached patent claims, to choose a different number of openings or channels in each nozzle, as it is likewise possible to vary the number of nozzles in dependence on the size of the screen plate or the number of screen plates.

Although the invention has been described with reference to the embodiment shown in the attached drawing, it is naturally possible to modify the invention within the scope of the attached patent claims.

I claim:

1. In a device for distributing liquid to paper pulp in a diffuser having at least one screen plate, and a means for supplying the liquid to be distributed, the improvement comprising:

at least a first and a second nozzle, each nozzle having a first end and a second end, wherein the first and second nozzles extend down in front of the screen plate and are arranged in order to cover the screen plate vertically;

the first and second nozzle second ends each adapted to be connected to the means for supplying the liquid;

the first and second nozzles each having at least three openings at different distances from said second ends for distributing liquid at different vertical levels on the screen plate;

the first and second nozzles each having at least three internal channels, each said channel operatively connected to a corresponding nozzle opening and each said channel extending from said nozzle second end to said corresponding nozzle opening to deliver the liquid from said liquid supplying means to said corresponding nozzle opening; and wherein said liquid supplying means comprise:

a nozzle plate having throttle holes, wherein each said nozzle second end is connected to one of the said throttle holes.

2. The device according to claim 1 wherein one of said nozzle openings is at said nozzle first end.

3. The device according to claim 1 wherein each of the distances between said second nozzle second end and the corresponding said second nozzle openings are less than the distances between said first nozzle second end and any of the said first nozzle openings.

* * * * *

UNITED STATES PATENT AND TRADEMARK OFFICE

CERTIFICATE OF CORRECTION

PATENT NO. : 5,900,123

DATED : May 4, 1999

INVENTOR(S) : Gustavsson

It is certified that error appears in the above-identified patent and that said Letters Patent is hereby corrected as shown below: On the title page,

Please correct the name of the assignee by deleting the word "Fulping" and inserting the word "Pulping" so the assignee name will read as follows:

Kvaerner Pulping AB

Signed and Sealed this

Twenty-eighth Day of September, 1999

*Attest:*

Q. TODD DICKINSON

*Attesting Officer*

*Acting Commissioner of Patents and Trademarks*